US010477295B2

(12) United States Patent
Ouchi et al.

(10) Patent No.: US 10,477,295 B2
(45) Date of Patent: Nov. 12, 2019

(54) EARPHONE

(71) Applicant: Onkyo Corporation, Osaka (JP)

(72) Inventors: Takashi Ouchi, Osaka (JP); Akira Tamadera, Osaka (JP); Masanori Ito, Osaka (JP); Naoki Imagawa, Osaka (JP)

(73) Assignee: Onkyo Corporation, Osaka (JP)

( * ) Notice: Subject to any disclaimer, the term of this patent is extended or adjusted under 35 U.S.C. 154(b) by 0 days.

(21) Appl. No.: 16/274,566

(22) Filed: Feb. 13, 2019

(65) Prior Publication Data

US 2019/0261078 A1 Aug. 22, 2019

(30) Foreign Application Priority Data

Feb. 19, 2018 (JP) ..... 2018-027333

(51) Int. Cl.

| | |
|---|---|
| ***H04R 1/00*** | (2006.01) |
| ***H04R 1/10*** | (2006.01) |
| ***H04R 1/24*** | (2006.01) |
| ***H04R 9/06*** | (2006.01) |
| ***H04R 1/28*** | (2006.01) |
| ***H04R 11/02*** | (2006.01) |

(52) U.S. Cl.

CPC ..... *H04R 1/1016* (2013.01); *H04R 1/24* (2013.01); *H04R 1/2896* (2013.01); *H04R 9/06* (2013.01); *H04R 11/02* (2013.01)

(58) Field of Classification Search

CPC ..... H04R 1/1016; H04R 1/24; H04R 1/1075

See application file for complete search history.

(56) References Cited

U.S. PATENT DOCUMENTS

| | | | | |
|---|---|---|---|---|
| 2011/0038503 | A1* | 2/2011 | Yang | H04R 1/22 381/380 |
| 2017/0064471 | A1* | 3/2017 | Andersen | H04R 1/24 |

FOREIGN PATENT DOCUMENTS

| | | | |
|---|---|---|---|
| JP | 2011-040933 | A | 2/2011 |
| JP | 3188023 | U | 12/2013 |

* cited by examiner

*Primary Examiner* — Matthew A Eason

(74) *Attorney, Agent, or Firm* — Renner, Otto, Boisselle & Sklar, LLP

(57) ABSTRACT

The present invention relates to a canal type earphone configured such that an outlet for a sound wave to be reproduced is inserted into an inlet of a user's ear canal. The earphone includes an electrodynamic speaker unit configured to electroacoustically convert an audio signal into a high-frequency sound wave containing a band component having a higher frequency than that of an audible band of a human being, thereby emitting the high-frequency sound wave; an electromagnetic speaker unit configured to electroacoustically convert the audio signal into a low-frequency sound wave containing more band components having a lower frequency than that of the high-frequency sound wave, thereby emitting the low-frequency sound wave; and a housing to the inside of which the electrodynamic speaker unit and the electromagnetic speaker unit are attached.

11 Claims, 5 Drawing Sheets

EARPHONE

BACKGROUND OF THE INVENTION

1. Field of the Invention

The present invention relates to an earphone attached to an ear of a user to reproduce audio, and specifically relates to an earphone configured such that a reproduced sound wave outlet is inserted into an inlet of the ear canal of the user.

2. Description of the Related Art

Headphones and earphones reproduce sound by application of audio signals to speaker units closely arranged in contact with users' ears. The earphones attached to the users' ears include various forms.

For example, the earphones include one, such as a headphone, including a relatively-large speaker unit and including an ear hooking portion attached such that a main body is mounted on the auricle. Moreover, the earphones include an inner ear type attached such that a main body is housed inside the auricle and used such that sound is emitted from a sound emission surface of the main body to the ear canal. Further, an earphone called a canal type has been spread, the earphone being attached such that a main body is housed inside the auricle and used such that a sound tube portion protruding from the main body is, together with an ear piece attached thereto, inserted into the ear canal.

It is more difficult for an electrodynamic speaker unit having a diaphragm exposed to the outside to obtain a high sound pressure level and sufficiently expand an audio reproduction frequency band to ensure favorable reproduction sound quality as the size of the electrodynamic speaker unit, i.e., a diaphragm bore, decreases. Similar problems are caused even in a speaker unit of the inner ear type or canal type earphone attached to the user's ear. Specifically, there are problems that it is difficult for the canal type earphone configured such that an outlet for a sound wave to be reproduced is inserted into an inlet of the ear canal of the user to employ a speaker unit configured such that a housing to which an electrodynamic speaker unit is attached is small and a diaphragm bore providing a necessary and sufficient audio reproduction capacity is large and the canal type earphone is susceptible to influence and limitations due to a housing structure.

The typical canal type earphones include one including an electromagnetic balanced armature speaker unit. The electromagnetic speaker unit also used for a hearing aid is, in some cases, smaller than the electrodynamic speaker unit. The electromagnetic speaker unit is configured to vibrate a diaphragm connected to a vibrating armature via a drive rod to convert an electric signal into a sound wave. The electromagnetic speaker unit is configured such that the diaphragm, a magnetic driver and the like are housed inside a case, an output hole for outputting a sound wave emitted from the diaphragm is provided at the case, and reproduced sound is emitted to the outside of the case.

Generally, the electromagnetic speaker unit does not have a broad reproduction frequency band. Thus, as in, e.g., JP-A-2011-040933, multiple electromagnetic speaker units having, e.g., different diaphragm areas are combined to form a two-way or three-way configuration with divided reproduction bands, and are housed in the housing of the canal type earphone.

However, further improvement has been demanded for the typical canal type earphone including the multiple speaker units. For this reason, an earphone has been typically present, which is configured such that an electromagnetic speaker unit exhibiting excellent reproduction sound quality for a mid- to high-frequency range is used for reproduction on a high-frequency side and an electrodynamic speaker unit is used for reproduction on a low-frequency side.

For example, Japanese Utility Model No. 3188023 discloses a dual dynamic type coaxial earphone. The earphone includes an earphone housing including a housing space and a sound emission hole and configured such that the housing space and the sound emission hole communicate with each other; a movable coil type speaker unit positioned in the housing space, provided facing the sound emission hole, and including a movable coil type diaphragm having a center diaphragm portion and a sound guide member having a sound guide hole corresponding to the center diaphragm portion; and a movable iron piece type speaker unit provided corresponding to the movable coil type speaker unit, including an armature type diaphragm, configured such that the armature type diaphragm is provided corresponding to the sound guide hole and therefore the armature type diaphragm and the movable coil type diaphragm are each positioned at both ends of the sound guide member, and configured such that a high-frequency sound wave generated at the armature type diaphragm is transmitted to the center diaphragm portion by way of the sound guide hole to cover a deficiency of high-frequency range expansion by the movable coil type diaphragm.

Specifically, in some cases, it has been demanded for a recent canal type earphone that audio with a broad reproduction frequency band including a higher limit frequency than that of a typical case can be reproduced to reproduce, e.g., a high-resolution audio signal having a frequency component much higher than an audible frequency band of a human being. However, although the electromagnetic speaker unit provides excellent reproduction sound quality for the mid- to high-frequency range, an upper limit frequency is low and is not sufficient for reproducing, e.g., the high-resolution audio signal. Thus, e.g., the earphone configured such that the electromagnetic speaker unit for the high frequency side and the electrodynamic speaker unit for the low frequency side are combined as in the Japanese Utility Model No. 3188023 has a problem that it is difficult to satisfy required predetermined standard and performance.

The present invention has been made for solving the problems of the above-described typical techniques. An object of the present invention relates to a canal type earphone configured such that an outlet for a sound wave to be reproduced is inserted into an inlet of a user's ear canal, and is to provide a composite earphone configured such that an electrodynamic speaker unit and an electromagnetic speaker unit are attached to reproduce audio with a broad reproduction frequency band including a higher limit frequency than that of a typical case and realize preferable clear audio reproduction.

SUMMARY OF THE INVENTION

The earphone of the present invention includes an electrodynamic speaker unit configured to electroacoustically convert an audio signal into a high-frequency sound wave containing a band component having a higher frequency than that of an audible band of a human being, thereby emitting the high-frequency sound wave; an electromagnetic speaker unit configured to electroacoustically convert the audio signal into a low-frequency sound wave containing more band components having a lower frequency than that of the high-frequency sound wave, thereby emitting the low-frequency sound wave; and a housing to the inside of which the electrodynamic speaker unit and the electromagnetic speaker unit are attached.

Preferably, in the earphone of the present invention, the electrodynamic speaker unit includes a magnetic circuit having a magnetic gap in which a voice coil is arranged, and a diaphragm coupled to the voice coil and exposed to the outside, and emits the high-frequency sound wave; and the electromagnetic speaker unit includes a magnetic driver having an armature portion configured to vibrate a drive rod portion, a diaphragm connected to the drive rod portion, and a case configured to house the magnetic driver and the diaphragm inside and forming an output hole for outputting a sound wave emitted from the diaphragm, and emits the low-frequency sound wave.

Moreover, preferably in the earphone of the present invention, in the housing, the electrodynamic speaker unit is attached such that a first acoustic space and a second acoustic space are defined on one side and the other side of the diaphragm of the electrodynamic speaker unit, and the electromagnetic speaker unit is attached and housed in the second acoustic space; and the housing includes a port portion configured to guide the low-frequency sound wave emitted by the electromagnetic speaker unit to the first acoustic space such that the low-frequency sound wave is not emitted to the second acoustic space, and a nozzle portion communicating with the first acoustic space to guide the low-frequency sound wave and the high-frequency sound wave emitted by the electrodynamic speaker unit to the ear canal of a user.

Further, preferably in the earphone of the present invention, the nozzle portion of the housing is formed in such a pipe shape that one side of the diaphragm of the electrodynamic speaker unit is able to be directly viewed at least from an end portion of the nozzle portion through an acoustic path formed inside the nozzle portion and the first acoustic space.

In addition, preferably in the earphone of the present invention, the housing further includes an inner leak port portion forming an acoustic path for communication between the first acoustic space and the second acoustic space.

Moreover, preferably in the earphone of the present invention, the inner leak port portion includes a housing member forming an outer shell of the housing, and an attachment member interposed and attached among the housing member, the electrodynamic speaker unit, and the electromagnetic speaker unit; and a groove provided at the housing member or the attachment member forms the acoustic path for communication between the first acoustic space and the second acoustic space.

Further, preferably in the earphone of the present invention, the housing further includes an outer leak port portion forming an acoustic path for communication between the first acoustic space and an external space or forming an acoustic path for communication between the second acoustic space and the external space.

In addition, the earphone of the present invention preferably further includes a network circuit having a circuit element configured to limit a band of the audio signal to a frequency band of equal to or higher than a predetermined frequency to supply the audio signal to the electrodynamic speaker unit and/or a circuit element configured to limit the band of the audio signal to a frequency band of equal to or lower than the predetermined frequency to supply the audio signal to the electromagnetic speaker unit.

Moreover, preferably in the earphone of the present invention, the predetermined frequency is a frequency of equal to or higher than 1 kHz and equal to or lower than 20 kHz.

Further, the earphone of the present invention preferably further includes an ear piece to be inserted into the ear canal of the user, and an earpiece attachment portion for attachment of the ear piece to the nozzle portion.

Hereinafter, features of the present invention will be described.

The earphone of the present invention includes the electrodynamic speaker unit configured to electroacoustically convert the audio signal into the high-frequency sound wave containing the band component having a higher frequency than that of the audible band of the human being, thereby emitting the high-frequency sound wave; the electromagnetic speaker unit configured to electroacoustically convert the audio signal into the low-frequency sound wave containing more band components having a lower frequency than that of the high-frequency sound wave, thereby emitting the low-frequency sound wave; and the housing to the inside of which the electrodynamic speaker unit and the electromagnetic speaker unit are attached. Thus, when the nozzle portion of the housing further has the ear piece attachment portion for attachment of the ear piece to be inserted into the ear canal of the user, a canal type earphone configured such that an ear piece closely contacts the ear canal can be realized.

The electrodynamic speaker unit described herein has the magnetic circuit having the magnetic gap in which the voice coil is arranged and the diaphragm coupled to the voice coil and exposed to the outside, and emits the high-frequency sound wave. Moreover, the electromagnetic speaker unit includes the magnetic driver having the armature portion configured to vibrate the drive rod portion, the diaphragm connected to the drive rod portion, and the case configured to house the magnetic driver and the diaphragm inside and forming the output hole for outputting the sound wave emitted from the diaphragm, and emits the low-frequency sound wave.

That is, the earphone of the present invention is configured such that the small electrodynamic speaker unit having a small diaphragm bore reproduces the high-frequency sound wave containing the band component having a higher frequency (equal to or higher than 20 kHz, preferably about 20 kHz to 40 kHz) than that of the audible band (20 Hz to 20 kHz) of the human being. Thus, even in a typical composite earphone configured such that an electrodynamic speaker unit and an electromagnetic speaker unit are attached to the earphone, audio with a broad reproduction frequency band having a higher limit frequency than that of a typical case can be reproduced, and required predetermined standard and performance can be satisfied while preferable clear audio reproduction can be realized.

Note that this earphone may further include the network circuit having the circuit element configured to limit the band of the audio signal to a frequency band of equal to or higher than the predetermined frequency to supply the audio signal to the electrodynamic speaker unit and/or the circuit element configured to limit the band of the audio signal to a frequency band of equal to or lower than the predetermined frequency to supply the audio signal to the electromagnetic speaker unit. The predetermined frequency is preferably a frequency of equal to or higher than 1 kHz and equal to or lower than 20 kHz. In a case where a unit providing excellent reproduction sound quality for a mid- to high-frequency range is employed as the electromagnetic speaker unit configured to reproduce the low-frequency sound wave, a reproduction band of the electromagnetic speaker unit is set broadly so that the reproduction sound quality of the composite earphone can be adjusted to excellent quality.

In the housing of this earphone, the electrodynamic speaker unit is attached such that the first acoustic space and the second acoustic space are defined on one side and the other side of the diaphragm of the electrodynamic speaker unit, and the electromagnetic speaker unit is attached and housed in the second acoustic space. Moreover, the housing may include the port portion configured to guide the low-frequency sound wave emitted by the electromagnetic speaker unit to the first acoustic space such that the low-frequency sound wave is not emitted to the second acoustic space, and the nozzle portion communicating with the first acoustic space to guide the low-frequency sound wave and the high-frequency sound wave emitted by the electrodynamic speaker unit to the ear canal of the user. When the nozzle portion of the housing is formed in such a pipe shape that one side of the diaphragm of the electrodynamic speaker unit can be directly viewed at least from the end portion of the nozzle portion through the acoustic path formed inside the nozzle portion and the first acoustic space, a reproduction sound pressure level of the high-frequency sound wave containing the band component having a higher frequency than that of the audible band of the human being can be increased, and an upper limit frequency can be more increased.

Moreover, the housing of the earphone of the present invention preferably further includes the inner leak port portion forming the acoustic path for communication between the first acoustic space and the second acoustic space. Alternatively, the housing preferably further includes the outer leak port portion forming the acoustic path for communication between the first acoustic space and the external space or forming the acoustic path for communication between the second acoustic space and the external space. Proper sound pressure frequency characteristics can be obtained in the canal type earphone, and as a result, natural preferable audio reproduction can be realized.

The earphone of the present invention is a composite earphone configured such that an electrodynamic speaker unit and an electromagnetic speaker unit are attached to the earphone, and can reproduce audio with a broad reproduction frequency band having a higher limit frequency than that of a typical case and can realize preferable clear audio reproduction.

DETAILED DESCRIPTION OF THE PREFERRED EMBODIMENTS

Hereinafter, an earphone according to preferred embodiments of the present invention will be described, but the present invention is not limited to these embodiments.

First Embodiment

Figure 1:
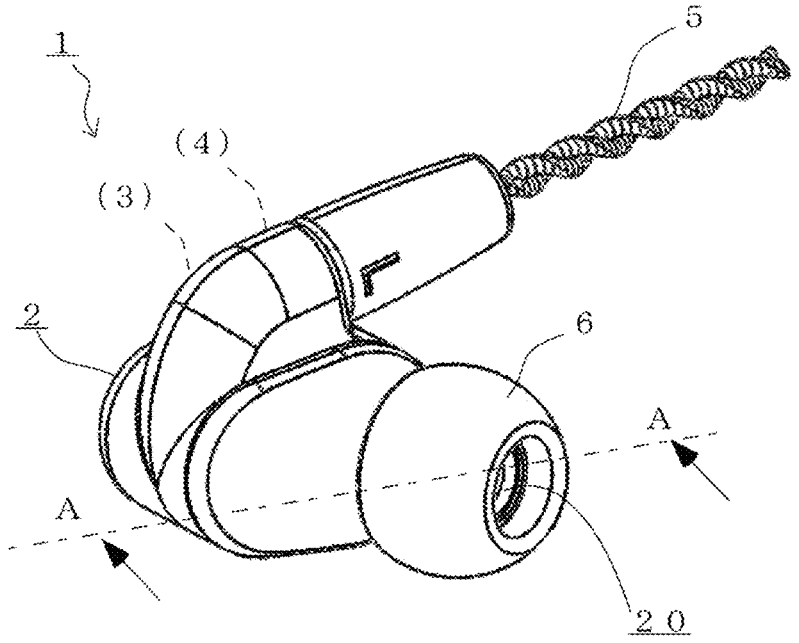
FIG. 1 is a view for describing an earphone according to a preferred embodiment of the present invention.
Figure 2:
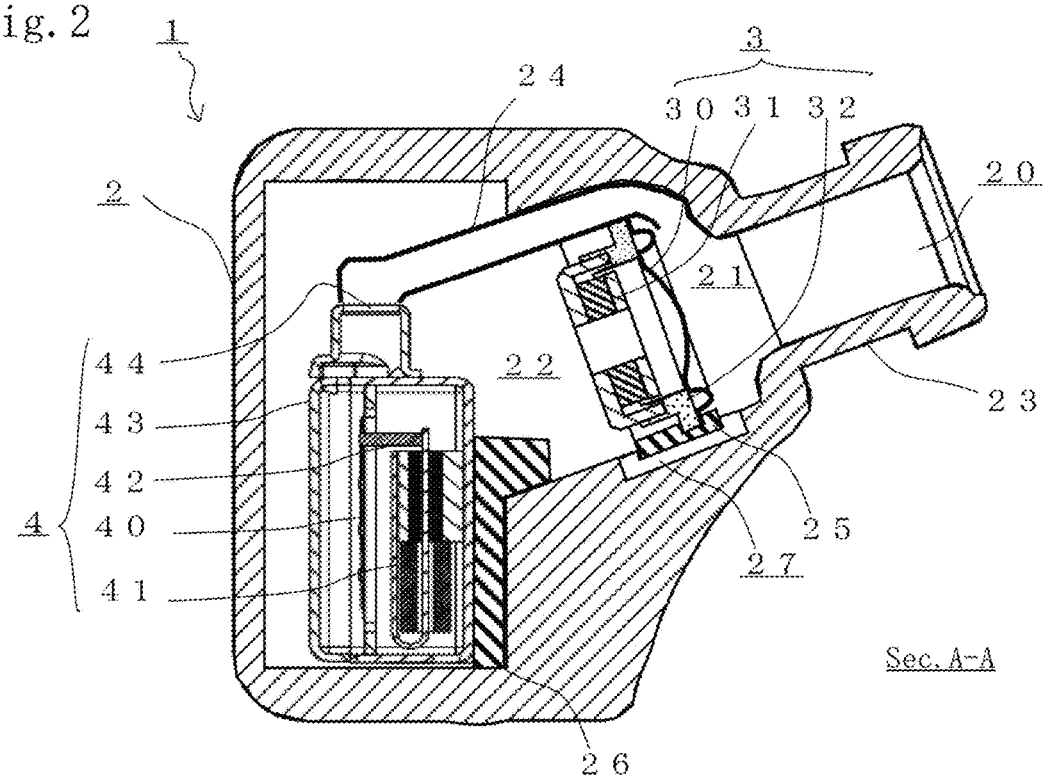
FIG. 2 is a view for describing an internal structure of the earphone according to the preferred embodiment of the present invention.
Figure 3A:
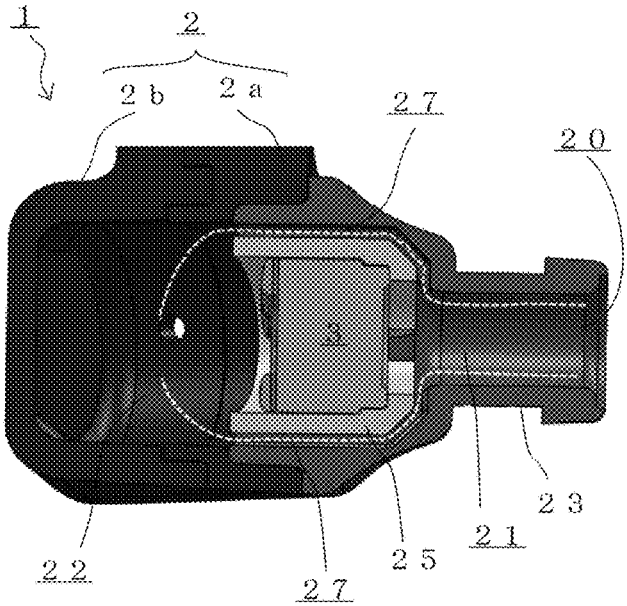
FIGS. 3A and 3B are views for describing the internal structure of the earphone according to the preferred embodiment of the present invention.
Figure 3B:
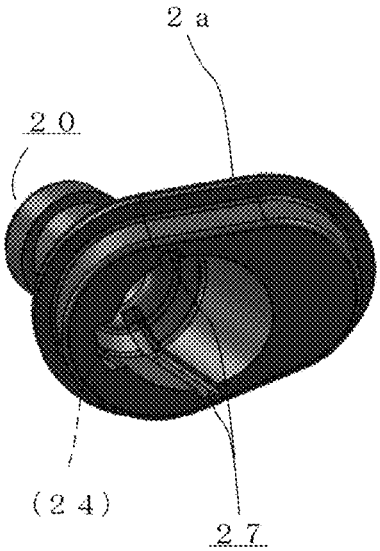

FIGS. 1, 2, 3A, and 3B are views for describing an earphone 1 according to a preferred embodiment of the present invention. Specifically, FIG. 1 illustrates a perspective view of the earphone 1 attached to one ear of a user. Moreover, FIG. 2 is an A-A sectional view for describing an internal structure of the earphone 1. Further, FIGS. 3A and 3B are views for describing the internal structure of the earphone 1, FIG. 3A being a partially-omitted sectional view and FIG. 3B being a perspective view of a first member 2*a* forming a housing 2. Note that other configurations of the earphone 1 unnecessary for description of the present invention will not be shown in the figures and not be described. For example, in FIG. 3A, an internal structure of an electrodynamic speaker unit 3, an electromagnetic speaker unit 4 and the like are not shown.

The earphone 1 of the present embodiment is a canal type earphone configured such that an outlet for a sound wave to be reproduced is inserted into the ear canal hole of the auricle of the user. The earphone 1 includes a substantially bilaterally-symmetrical earphone to be attached to each of the right and left ears of the user, and is adaptable to stereo reproduction. Hereinafter, a configuration of the earphone 1 corresponding to one ear will be described. Needless to say, the form of the earphone 1 is not limited to that in the case of the present embodiment.

The composite earphone 1 is configured such that the electrodynamic speaker unit 3 and the electromagnetic speaker unit 4 for reproducing sound by means of an audio signal supplied via a cord 5 are attached to the inside of the housing 2. An ear piece attachment portion for attachment of an ear piece 6 is formed at a nozzle portion 23 of the housing 2 provided with an output hole 20 for a sound wave output from these speaker units. When the hat-shaped ear piece 6 exhibiting elasticity is attached, the canal type earphone configured such that the ear piece 6 closely contacts the ear canal hole of the user can be realized. By the ear piece 6, the earphone 1 can be stably attached to the auricle of the user.

The electrodynamic speaker unit 3 having a bore corresponding to the size of the ear canal hole of the auricle of the user and the large electromagnetic speaker unit 4 having a greater entire length than that of the electrodynamic speaker unit 3 can be attached to the housing 2 of the present embodiment. The housing 2 may include the substantially cylindrical first member 2*a* including the nozzle portion 23, and a second member 2*b* coupled to a back side of the first member 2*a* to form a cavity. The housing 2 includes a cord connection portion made of a metal material or a resin material and provided for connection of the cord 5 for supplying the audio signal.

In the housing 2, the electrodynamic speaker unit 3 is arranged on a side close to the nozzle portion 23 provided with the sound wave output hole 20, and the electromagnetic speaker unit 4 is arranged on a side far from the nozzle portion 23. The electrodynamic speaker unit 3 is configured to electroacoustically convert the audio signal into a high-frequency sound wave (i.e., a sound wave containing a band component of equal to or higher than 20 kHz) containing a band component having a higher frequency than that of an audible band (20 Hz to 20 kHz) of a human being, thereby emitting the resultant signal. On the other hand, the electromagnetic speaker unit 4 is configured to electroacoustically convert the audio signal into a low-frequency sound wave containing more band components having a lower frequency than that of the high-frequency sound wave, thereby emitting the resultant signal.

The electrodynamic speaker unit 3 has a magnetic circuit 31 with a magnetic gap where a voice coil is arranged, a substantially dome-shaped diaphragm 30 coupled to the voice coil and exposed to the outside, and a frame 32 coupling the diaphragm 30 and the magnetic circuit 31. The electrodynamic speaker unit 3 emits sound waves in a reversed-phase relationship between front and back sides of the diaphragm 30. The electrodynamic speaker unit 3 is attached such that the frame 32 thereof is coupled to an inner wall surface of the housing 2 via an attachment member 25 and separates one side and the other side of the diaphragm 30 of the electrodynamic speaker unit 3.

The housing 2 defines an acoustic space 21 on the front side of the diaphragm 30 of the electrodynamic speaker unit 3, and forms an acoustic space 22 on the back side on which the magnetic circuit of the electrodynamic speaker unit 3 is present. Moreover, the electromagnetic speaker unit 4 is attached and housed inside the acoustic space 22. The electromagnetic speaker unit 4 is coupled to the inner wall surface of the housing 2 via an attachment member 26. Thus, the high-frequency sound wave emitted to the front acoustic space 21 by the electrodynamic speaker unit 3 and the high-frequency sound wave emitted to the back acoustic space 22 are in a reversed-phase relationship.

The electromagnetic speaker unit 4 has a magnetic driver 41 with an armature portion for vibrating a drive rod portion 42, a diaphragm 40 connected to the drive rod portion 42, and a case 43 configured to house the magnetic driver 41 and the diaphragm 40 inside and forming an output hole 44 for outputting the sound wave emitted from the diaphragm 40. The electromagnetic speaker unit 4 emits the low-frequency sound wave. A tubular port portion 24 configured to guide the low-frequency sound wave emitted by the electromagnetic speaker unit 4 to the acoustic space 21 is connected to the output hole 44 of the electromagnetic speaker unit 4.

The port portion 24 may be formed of a tube or a flexible tubular body, or may be a pipe made of a resin material or a metal material. In the case of the present embodiment, one end side of the long pipe-shaped port portion 24 communicates with the output hole 44 of the electromagnetic speaker unit 4, and the other end side of the port portion 24 communicates with the acoustic space 21. Thus, the low-frequency sound wave as sound emitted from the electromagnetic speaker unit 4 is not emitted to the acoustic space 22.

The acoustic space 21 communicates with the output hole 20 formed at an end portion of the nozzle portion 23 of the housing 2, the end portion being thinly formed on a tip end side such that the nozzle portion 23 is insertable into the ear canal hole of the auricle of the user. The nozzle portion 23 forms an acoustic path inside, the acoustic path communicating with the acoustic space 21 to guide the sound wave to the ear canal of the user. The nozzle portion 23 is formed in such a pipe shape that one side of the diaphragm 30 of the electrodynamic speaker unit 3 can be directly viewed at least through the output hole 20 as the end portion of the nozzle portion 23.

Thus, the high-frequency sound wave emitted by the electrodynamic speaker unit 3 and the low-frequency sound wave emitted by the electromagnetic speaker unit 4 are synthesized in the acoustic space 21, and then, are emitted from the output hole 20 communicating with the acoustic space 21. Note that a protection net as a protection member exhibiting air permeability may be attached to the opening end portion of the nozzle portion 23. The protection net can prevent failure such as closing of the acoustic path due to an extraneous substance entering through the opening end portion of the nozzle portion.

The housing 2 of the present embodiment includes an acoustic path 27 as an inner leak port portion for communication between the acoustic space 21 and the acoustic space 22 in the housing 2. In the present embodiment, the acoustic path 27 is formed between a groove provided at a housing member forming the housing 2 and the attachment member 25 interposed between the housing member and the electrodynamic speaker unit 3 to attach these components to each other. The attachment member 25 is formed in a tubular shape covering an outer peripheral side of the frame 32 of the electrodynamic speaker unit 3. Thus, as illustrated in FIGS. 3A and 3B, the groove forming the acoustic path 27 is formed in such a manner that the thickness of the first member 2*a* forming the housing 2 is reduced than those of other portions across a predetermined length.

The attachment member 25 is formed in the tubular shape covering the outer peripheral side of the frame 32 of the electrodynamic speaker unit 3, and therefore, the groove forming the acoustic path 27 may be provided at the attachment member 25. In the case of providing a groove with a predetermined length at the housing 2 or the attachment member 25 having a predetermined thickness, the groove can be formed not only in a manner that the thickness is reduced as compared to other portions but also in a manner that the thickness is increased as compared to other portions to provide a rib.

The housing 2 or the attachment member 25 having the groove can be easily manufactured, and therefore, there are advantages that the acoustic path 27 can be realized at low cost and the quality of the earphone 1 is stabilized. Moreover, the acoustic path 27 as a leak port for communication between the first acoustic space 21 as the front space of the diaphragm 30 and the second acoustic space 22 is formed, and therefore, sound leakage to the outside is reduced. As a result, sound leakage to the vicinity of the ear canal does not occur, and therefore, favorable preferable audio reproduction can be implemented without lowering of reproduction sound quality.

Further, in a case where the ear piece 6 of the earphone 1 closely contacts the ear canal of the user and substantially blocks an inner space of the ear canal and an outer free space from each other, the degree of sealing of the inner space of the ear canal is high. Thus, there is a problem that when the earphone 1 is inserted into or detached from the ear canal of a listener, a change in atmospheric pressure in the inner space of the ear canal is great and a great atmospheric pressure change is applied on the diaphragm 30 of the electrodynamic speaker unit 3. In some cases, the electrodynamic speaker unit 3 is damaged. In the present embodiment, the acoustic path 27 is provided as the inner leak port portion for communication between the acoustic space 21 and the acoustic space 22 in the housing 2. With this configuration, an atmospheric pressure change is applied from one side and the other side of the diaphragm 30, and therefore, failure such as damage of the electrodynamic speaker unit 3 can be prevented.

Figure 4:
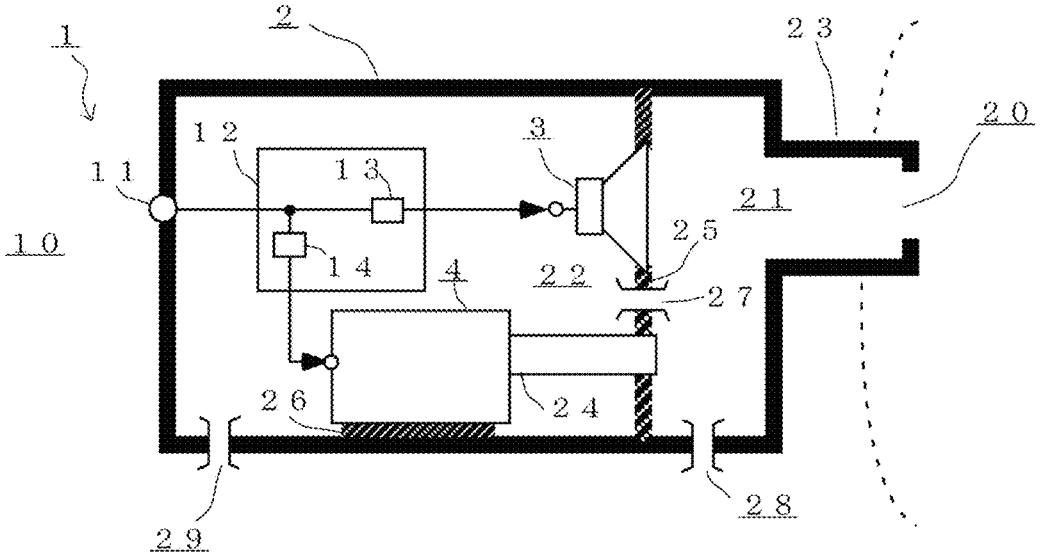
FIG. 4 is a view for describing a leak port structure and a network circuit of the earphone according to the preferred embodiment of the present invention.

FIG. 4 is a schematic diagram for describing a leak port structure and a network circuit of the earphone 1. In this schematic diagram, the configuration of the earphone 1 including the housing 2 is simply illustrated in terms of function.

The housing 2 may include not only the acoustic path 27 described above, but also a leak hole or port communicating with the acoustic space 21 or the acoustic space 22 to guide the sound wave to an external space. For example, an acoustic path 28 for communication between the acoustic space 21 and the external space may be provided at the housing 2, and an acoustic path 29 for communication between the acoustic space 22 and the external space may be provided at the housing 2.

One or more combinations of the above-described multiple acoustic paths 27, 28 and 29 can be provided as the leak holes or ports at the housing 2. For example, when the housing 2 includes, in addition to the above-described acoustic path 27, the acoustic path 29 for communication between the acoustic space 22 and the external space, an atmospheric pressure change in the acoustic space 21 can be transferred to the acoustic space 22, and can be further transferred to the external space. Similarly, a combination of the acoustic paths 27, 28, a combination of the acoustic paths 28, 29, and a combination of the acoustic paths 27, 28 and 29 are available.

The earphone 1 may include a network circuit 12 configured to limit a band of an audio signal input to an input terminal 11 to supply the resultant signal to the electrodynamic speaker unit 3 and the electromagnetic speaker unit 4. The network circuit 12 includes a circuit element 13 configured to limit the band of the audio signal to a frequency band of equal to or higher than a predetermined frequency to supply the resultant signal to the electrodynamic speaker unit 3 and/or a circuit element 14 configured to limit the band of the audio signal to a frequency band of equal to or lower than the predetermined frequency to supply the resultant signal to the electromagnetic speaker unit 4.

For example, the circuit element 13 of the network circuit 12 connected to the electrodynamic speaker unit 3 preferably includes a capacitor element connected in series to supply, to the electrodynamic speaker unit 3, a high-frequency component containing at least a band component of equal to or higher than a predetermined frequency of equal to or higher than 1 kHz and equal to or lower than 20 kHz. Needless to say, a resistor element configured to adjust a reproduction level may be provided as the circuit element 13 of the network circuit 12.

For example, the circuit element 14 of the network circuit 12 connected to the electromagnetic speaker unit 4 may be a circuit element, such as a coil, as an inductance element configured to limit a band of an audio signal to a frequency band of equal to or lower than a predetermined frequency, or a circuit element such as a capacitor connected in parallel to bypass a frequency band of equal to or higher than a predetermined frequency to a signal ground. Note that the circuit element 14 may be a resistor element connected in series to adjust a reproduction level, or may be directly connected without connection of a resistor element or the like.

Figure 5:
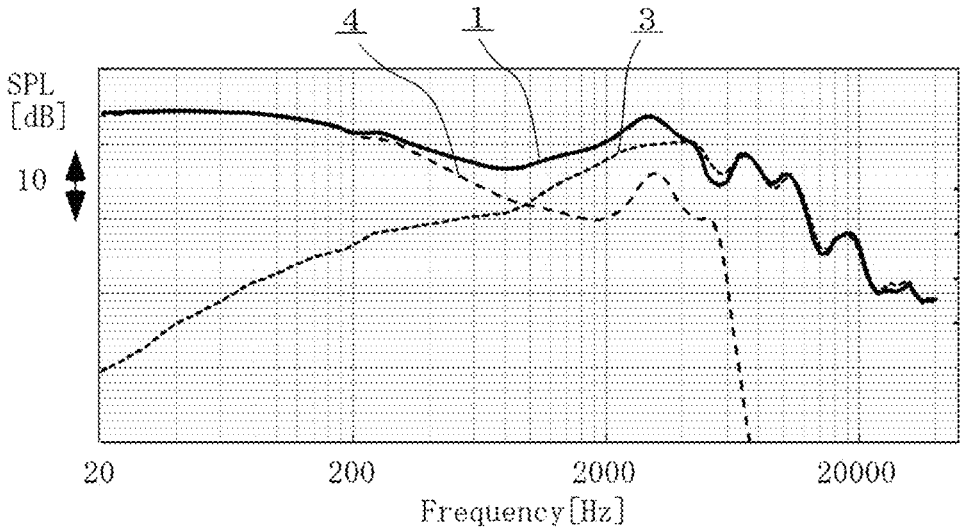
FIG. 5 is a graph for describing sound pressure frequency characteristics of the earphone according to the preferred embodiment of the present invention.

FIG. 5 is a graph for describing sound pressure frequency characteristics of the earphone 1 of the present embodiment, the horizontal axis indicating the frequency of the input audio signal and the vertical axis indicating, as a solid line, a sound pressure level at the ear canal in the case of attachment to an ear model as a measurement tool. Moreover, sound pressure frequency characteristics in the case of using only the electrodynamic speaker unit 3 and sound pressure frequency characteristics in the case of using only the electromagnetic speaker unit 4 are, as comparative examples, overwritten as dotted lines.

The composite earphone 1 is configured so that broad sound pressure frequency characteristics allowing reproduction of a high-frequency sound wave including 20 kHz to 40 kHz are realized as illustrated in FIG. 5. This is because the small electrodynamic speaker unit 3 having a small diaphragm bore reproduces the high-frequency sound wave containing the band component having a higher frequency (equal to or higher than 20 kHz, preferably about 20 kHz to 40 kHz) than that of the audible band (20 Hz to 20 kHz) of the human being. On the other hand, in the case of only the electromagnetic speaker unit 4, the reproduction sound pressure level at equal to or higher than 4 kHz is low, and therefore, is not suitable for reproduction of a high-frequency sound wave. However, the reproduction sound pressure level for a low-frequency sound wave is higher than that of the electrodynamic speaker unit 3, and therefore, a broad reproduction frequency band can be realized.

The earphone 1 of the present embodiment is improved such that substantially flat characteristics are exhibited at about 300 Hz to 1 kHz as compared to the case of using the speaker unit 3, 4 alone. As a result, articulation of reproduced audio can be improved. The canal type earphone 1 configured such that the reproduced sound wave outlet is inserted into the inlet of the ear canal of the user can realize natural preferable audio reproduction. When the sound pressure at around 300 Hz does not decrease as in the case of the present embodiment described above, articulation of reproduced audio can be enhanced to prevent lowering of reproduction sound quality.

Specifically, the output hole 20 of the nozzle portion 23 of the housing 2 is preferably formed in such a pipe shape that one side of the diaphragm. 30 of the electrodynamic speaker unit 3 can be directly viewed from the output hole 20 through the acoustic path and the acoustic space 21 formed inside the output hole 20 as described in the present embodiment. The high-frequency sound wave emitted from the diaphragm 30 of the electrodynamic speaker unit 3 has a short wavelength, and exhibits high directivity. Thus, it is suitable to emit many components not reflected on the wall surface forming the acoustic path. The reproduction sound pressure level of the high-frequency sound wave containing the band component having a higher frequency than that of the audible band of the human being is increased so that an upper limit frequency can be more increased. As a result, in the earphone 1 of the present embodiment, predetermined standard and performance required for reproduction of, e.g., a high-resolution audio signal can be satisfied.

Note that in the composite earphone 1, the electrodynamic speaker unit 3 and the electromagnetic speaker unit 4 may be connected in parallel such that the same audio signal is input. However, when the earphone 1 has the network circuit 12 with a circuit element configured to supply a band-limited signal or a circuit element configured to supply a level-adjusted signal, adjustment of the sound pressure frequency characteristics is facilitated, and sound pressure frequency characteristics suitable for the composite earphone 1 can be realized.

Note that in the case of the present embodiment, one end side of the long pipe-shaped port portion 24 communicates with the output hole 44 of the electromagnetic speaker unit 4, and the other end side of the port portion 24 communicates with the acoustic space 21. Thus, the low-frequency sound wave as the sound emitted from the electromagnetic speaker unit 4 is not emitted to the acoustic space 22. However, the port portion 24 may be shortened such that one end side thereof is not directly attached to the output hole 44 of the electromagnetic speaker unit 4, for example. That is, it may be configured such that the sound wave emitted from the output hole 44 of the electromagnetic speaker unit 4 enters one end side of the port portion 24 after having been emitted to the acoustic space 22. The acoustic space 22 can function as an acoustic capacitor forming an acoustic high cut filter.

The port portion 24 of the housing 2 is not necessarily configured such that the acoustic path communicating with the acoustic space 21 is formed by the tube or the flexible tubular body, and instead, a pipe portion having a similar cross-sectional area may be provided to penetrate outer and inner wall portions of the housing member. Alternatively, the entirety of the port portion 24 is not necessarily formed of the flexible tubular body, and instead, part of the port portion 24 may be the above-described pipe portion penetrating the outer and inner wall portions of the housing member. Other cover members attached to the housing member may be used to provide a leak port as an alternative to the acoustic path 27, 28 and 29.

The earphone of the present invention is not limited to the illustrated canal type earphone, and may be an earphone further including another ear hooking portion. Moreover, the present invention is not limited to the earphone, and may be overhead type earphones configured such that earphones corresponding to both of the right and left ears are coupled to each other via a headband. The earphone is not limited to stereo reproduction or multichannel surround reproduction for home use, and is also applicable to in-vehicle audio equipment and an acoustic reproduction facility such as a movie theater.

What is claimed is:

1. An earphone comprising:

an electrodynamic speaker unit configured to electroacoustically convert an audio signal into a high-frequency sound wave containing a band component having a higher frequency than that of an audible band of a human being, thereby emitting the high-frequency sound wave;

an electromagnetic speaker unit configured to electroacoustically convert the audio signal into a low-frequency sound wave containing more band components having a lower frequency than that of the high-frequency sound wave, thereby emitting the low-frequency sound wave; and a housing to an inside of which the electrodynamic speaker unit and the electromagnetic speaker unit are attached, wherein in the housing, the electrodynamic speaker unit is attached such that a first acoustic space and a second acoustic space are defined on one side and the other side of a diaphragm of the electrodynamic speaker unit, and the electromagnetic speaker unit is attached and housed in the second acoustic space, the housing includes a nozzle portion communicating with the first acoustic space to guide the low-frequency sound wave and the high-frequency sound wave to an ear canal of a user, and the nozzle portion of the housing is formed in such a pipe shape that the one side of the diaphragm of the electrodynamic speaker unit is able to be directly viewed at least from an end portion of the nozzle portion through an acoustic path formed inside the nozzle portion and the first acoustic space.

2. The earphone according to claim 1, wherein the electrodynamic speaker unit includes a magnetic circuit having a magnetic gap in which a voice coil is arranged, and the diaphragm coupled to the voice coil and exposed to an outside, and emits the high-frequency sound wave, and the electromagnetic speaker unit includes a magnetic driver having an armature portion configured to vibrate a drive rod portion, a diaphragm connected to the drive rod portion, and a case configured to house the magnetic driver and the diaphragm inside and forming an output hole for outputting a sound wave emitted from the diaphragm, and emits the low-frequency sound wave.

3. The earphone according to claim 1, wherein the housing further includes a port portion configured to guide the low-frequency sound wave emitted by the electromagnetic speaker unit to the first acoustic space such that the low-frequency sound wave is not emitted to the second acoustic space.

4. The earphone according to claim 3, wherein the housing further includes an inner leak port portion forming an acoustic path for communication between the first acoustic space and the second acoustic space.

5. The earphone according to claim 4, wherein the inner leak port portion includes a housing member forming an outer shell of the housing, and an attachment member interposed and attached among the housing member, the electrodynamic speaker unit, and the electromagnetic speaker unit, and a groove provided at the housing member or the attachment member forms the acoustic path for communication between the first acoustic space and the second acoustic space.

6. The earphone according to claim 3, wherein the housing further includes an outer leak port portion forming an acoustic path for communication between the first acoustic space and an external space or forming an acoustic path for communication between the second acoustic space and the external space.

7. The earphone according to claim 1, further comprising:

a network circuit including a circuit element configured to limit a band of the audio signal to a frequency band of equal to or higher than a predetermined frequency to supply the audio signal to the electrodynamic speaker unit, and/or a circuit element configured to limit the band of the audio signal to a frequency band of equal to or lower than the predetermined frequency to supply the audio signal to the electromagnetic speaker unit.

8. The earphone according to claim 7, wherein the predetermined frequency is a frequency of equal to or higher than 1 kHz and equal to or lower than 20 kHz.

9. The earphone according to claim 1, further comprising:

an ear piece to be inserted into the ear canal of the user; and an ear piece attachment portion for attachment of the ear piece to the nozzle portion.

10. An earphone comprising:

an electrodynamic speaker unit configured to electroacoustically convert an audio signal into a high-frequency sound wave containing a band component having a higher frequency than that of an audible band of a human being, thereby emitting the high-frequency sound wave;

an electromagnetic speaker unit configured to electroacoustically convert the audio signal into a low-frequency sound wave containing more band components having a lower frequency than that of the high-frequency sound wave, thereby emitting the low-frequency sound wave; and a housing to an inside of which the electrodynamic speaker unit and the electromagnetic speaker unit are attached, wherein in the housing, the electrodynamic speaker unit is attached such that a first acoustic space and a second acoustic space are defined on one side and the other side of a diaphragm of the electrodynamic speaker unit, and the electromagnetic speaker unit is attached and housed in the second acoustic space, the housing includes an inner leak port portion forming an acoustic path for communication between the first acoustic space and the second acoustic space, the inner leak port portion includes a housing member forming an outer shell of the housing, and an attachment member interposed and attached among the housing member, the electrodynamic speaker unit, and the electromagnetic speaker unit, and a groove provided at the housing member or the attachment member forms the acoustic path for communication between the first acoustic space and the second acoustic space.

11. The earphone according to claim 10, wherein the housing further includes a port portion configured to guide the low-frequency sound wave emitted by the electromagnetic speaker unit to the first acoustic space such that the low-frequency sound wave is not emitted to the second acoustic space, and a nozzle portion communicating with the first acoustic space to guide the low-frequency sound wave and the high-frequency sound wave emitted by the electrodynamic speaker unit to an ear canal of a user.

* * * * *